United States Patent [19]

Jackson et al.

[11] 4,092,160

[45] May 30, 1978

[54] ION MODULATOR HAVING BIAS ELECTRODE FOR REGULATING CONTROL FIELDS

[75] Inventors: Jerome E. Jackson, Shaker Heights; John D. Blades, Chagrin Falls, both of Ohio

[73] Assignee: Addressograph-Multigraph Corp., Cleveland, Ohio

[21] Appl. No.: 561,681

[22] Filed: Mar. 25, 1975

[51] Int. Cl.[2] ..... G03G 13/00

[52] U.S. Cl. ..... 96/1 R; 96/1.5 N; 355/3 SC

[58] Field of Search ..... 96/1.5, 1 R, 1 A; 355/3 SC; 346/74 J, 74 EB, 74 ES

[56] References Cited

U.S. PATENT DOCUMENTS

| | | | |
|---|---|---|---|
| 3,582,206 | 6/1971 | Burdige | 96/1 |
| 3,680,954 | 9/1965 | Frank | 96/1 |
| 3,797,926 | 3/1974 | Fotland et al. | 358/3 |
| 3,839,027 | 10/1974 | Pressman | 96/1 |
| 3,880,513 | 4/1975 | Fotland et al. | 358/3 |
| 3,881,921 | 5/1975 | Frank | 96/1 |

*Primary Examiner*—John D. Welsh
*Attorney, Agent, or Firm*—Michael A. Kondzella

[57] ABSTRACT

An ion modulator having a bias electrode is capable of producing copies in which the contrast and background are controllable. Such modulator functions in a process which utilizes an adjustable charge density applied to set up uniform fringing fields of the desired magnitude which block ions directed towards background (light) areas. Funneling fields are set up in image (dark) areas in opposition to the original fringing fields by simultaneous imaging and ion projection, decreasing the effect of such fringing fields and permitting ions to pass through the modulator in image areas.

11 Claims, 4 Drawing Figures

ION MODULATOR HAVING BIAS ELECTRODE FOR REGULATING CONTROL FIELDS

BACKGROUND OF THE INVENTION

This invention relates to electrophotographic processes and apparatus. In one of its more particular aspects this invention relates to a multilayered ion modulator and its use in improved electrophotographic processes.

Electrophotographic reproduction techniques for making copies of graphic originals using photoconductive media are well known. Such processes generally call for applying a blanket electrostatic charge to a photoconductor in the dark and then exposing the charged photoconductor to a pattern of light and shadow created by directing electromagnetic radiation onto a graphic original. The light-struck areas of the photoconductor are discharged leaving behind a latent electrostatic image corresponding to the original. A developed image is produced by applying an electroscopic powder to the latent electrostatic image and then fixing the image or transferring and fixing onto a suitable receiving medium such as plain paper.

This technique has been extended to foraminated structures which are formed by applying a photoconductive layer to a conductive screen or similar apertured structure. Such structures function as ion modulators selectively passing a stream of ions through the apertures of the screen in a pattern corresponding to the graphic original to be reproduced.

The ion modulators which have been developed heretofore and are known in the prior art fall into several distinct classes:

The first is a simple two-layered screen or grid construction which is formed by applying a photoconductive layer onto an apertured metallic substrate as disclosed in U.S. Pat. No. 3,220,324 to Christopher Snelling. Such a structure can be used to apply to a dielectric target an electrostatic charge corresponding to a pattern of light and shadow created by electromagnetic radiation directed onto a graphic original resulting in the creation of a latent electrostatic image thereon. Some fraction of the ions creating the latent electrostatic image, however, are allowed to pass through the apertures in areas of the modulator corresponding to background areas in the original. Copies which are made from electrostatic latent images created in this manner therefore do not generally display the high contrast and low background levels desired.

A second group of photoconductive screens of various constructions has been adapted for use with charged material particles such as charged electroscopic powders. Typical of such screens are those disclosed in U.S. Pat. No. 3,694,200 to G. L. Pressman. Such structures suffer from the deficiency that charged particles accumulate in those areas of structure which attract the particles so that ultimately, it is required that the screen be cleaned to physically remove the particles in order that the screen may be reused.

The use of such screens with ions rather than charged electroscopic powders is disclosed in U.S. Pat. No. 3,645,614 to Samuel B. McFarlane, Jr., Joseph Burdige and Norman E. Alexander.

While the prior art modulators have advanced the electrophotographic art, there are disadvantages which need to be overcome in order to provide an ion modulator system which can be operated so that copies of high quality can be made.

OBJECTS

It is accordingly an object of this invention to provide improved electrophotographic apparatus and processes.

It is another object of this invention to provide improved ion modulators which are capable of being operated to produce copies of high quality.

Another object of this invention is to provide a process utilizing an ion modulator which can produce copies displaying high contrast and low background levels.

Another object of this invention is to provide means for controlling the contrast and background in the copies produced.

Other objects and advantages of this invention will become apparent in the course of the following detailed disclosure and description.

SUMMARY OF THE INVENTION

The ion modulator of this invention consists of a conductive screen or grid coated on one side with a photoconductive material and coated on the other side with an insulating material, which may or may not be photoconductive, and equipped with a conducting layer serving as an electrode for applying a bias potential between the conducting layer and the screen.

A charge density of appropriate polarity applied by means of such electrode sets up uniform fringing fields which block ions directed toward background (light) areas. The magnitude of such fringing fields can be controlled by adjusting the bias potential. Funneling fields set up in image (dark) areas in opposition to such fringing fields by simultaneous imaging and ion projection decrease the effect of such fringing fields. The net result is that ions projected towards the modulator are funneled through apertures in image areas and blocked from going through apertures in background areas. A suitable dielectric surface placed in the path of ions projected through the modulator thus receives a latent electrostatic image corresponding to the original being copied. Development of the latent electrostatic image by toning with an electroscopic powder and fixing, for example by heat or pressure produces a permanent copy upon such dielectric surface. If desired the latent electrostatic image can be toned and then transferred from the dielectric surface to a suitable receiving surface such as plain paper and fixed thereon.

THE DRAWING

DESCRIPTION OF THE PREFERRED EMBODIMENTS

Figure 1:
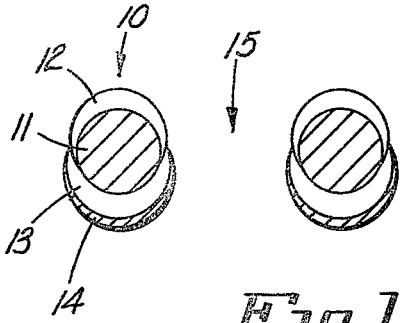
FIG. 1 is a diagrammatic cross-sectional view of one embodiment of a portion of an ion modulator according to this invention.

Referring to FIG. 1, there is shown in cross-section a diagrammatic view of an ion modulator according to one embodiment of this invention. The modulator 10 consists of conductor 11 coated on one side with photoconductor 12 and on the opposite side with insulator 13.

Deposited upon insulator 13 is conductor 14 which functions as a bias electrode. The apertures in the ion modulator are generally indicated by the numeral 15.

Conductor 11 can be a nickel, copper, brass, aluminum or stainless steel screen which is produced by electroforming or can be a metallic grid produced by means of photochemical machining. Conductor 11 can also be any other conductive material produced by any conventional method of producing an apertured configuration, such as a wire cloth material. Conductor 11 may be any convenient size but is preferably in the range of 10–50 microns in thickness. For example, a 200 mesh wire screen in which the wire diameter is 50 microns and the average aperture size is about 74 microns in the widest dimension can be used.

Photoconductor 12 is preferably from about 3 microns to 20 microns in thickness and may be selected from a wide variety of known photoconductors including inorganic and organic materials. Selenium, zinc oxide and cadmium sulfide are representative of satisfactory inorganic materials. Various organic polymeric photoconductors such as polyvinylcarbazole, the polyvinylbenzocarbazoles described in U.S. Pat. No. 3,751,246 to Helen C. Printy and Evan S. Baltazzi and polyvinyliodobenzocarbazoles described in U.S. Pat. No. 3,764,316 to Earl E. Dailey, Jerry Barton, Ralph L. Minnis and Evan S. Baltazzi are also satisfactory photoconductors. Other organic photoconductors which can be used include monomeric photoconductors which require dispersion in a suitable vehicle, for example, in a resin binder. These photoconductors include the benzofluorenes and dibenzofluorenes described in U.S. Pat. No. 3,615,412 to William J. Hessel and the cumulenes described in U.S. Pat. No. 3,674,473 to Robert G. Blanchette all assigned to the same assignee as this invention. In many instances organic photoconductors, both polymeric and monomeric can be used with a suitable sensitizer to extend the spectral range of the photoconductor. For example, dyes can be used for this purpose. Another class of materials which are widely used are the pi-acids. Representative of these compounds are the oxazolone and butenolide derivatives of fluorenone described in U.S. Pat. No. 3,556,785 to Evan S. Baltazzi, the dicyanomethylene substituted fluorenes described in U.S. Pat. No. 3,752,668 to Evan S. Baltazzi, and the bianthrones described in U.S. Pat. No. 3,615,411 to William J. Hessel, all assigned to the same assignee as this invention.

Thus any standard photoconductive composition suitable in xerographic applications can be used as a coating in fabricating the ion modulator of this invention. In order to optimize the operation thereof, however, it is essential that, in the presence of ions, the photoconductor not charge in the light. This criterion will be met if the photocurrent is the same as the incident ion flux. Such has been found to be the case where the transport of hole carriers produced by the usual light fluxes obtained in xerographic systems is sufficient to equalize the ion flux. Another requirement of the photoconductor is that it be free of deep traps so that the hole carriers are not immobilized. Both requirements have been found to be met by the use of a photoconductive layer of pure selenium deposited as described in copending application of Norman C. Miller, Ser. No. 561,702, filed Mar. 25, 1975.

Any insulating material, organic or inorganic, can be used as insulator 13. Polymeric insulating compositions such as a vinyl resin, for example, polystyrene, a polypropylene or an acrylic resin; a polyester, such as a polycarbonate or polyterephthalate; an epoxy resin or a silicone are suitable. Inorganic insulating materials which can be used for this purpose include silicon dioxide, silicon nitride and boron nitride. Insulator 13 can be deposited upon conductor 11 by means of any suitable coating technique, such as by sputtering an inorganic insulating material upon the surface of the conductive substrate or spraying thereon a suitable organic polymer and can be applied to provide a thickness of about from 2 microns to 20 microns.

Insulators which have low charge decay rates are preferred. The insulator should also be inert to degradation caused by corona discharge. Polystyrene, polyesters and polydiphenylsiloxanes have been found to meet these requirements and are accordingly preferred.

Either the photoconductor or the insulator can be applied to the screen first as desired.

Conductor 14 serving as a bias electrode can be of the same material as conductor 11. Vacuum deposition of aluminum or other conductive metal results in an electrode having the properties desired and is therefore preferred. Other methods of depositing a conductive layer as described with reference to conductor 11 are also satisfactory. The thickness of conductor 14 can be varied from about 0.1 micron to 2 microns.

Figure 2:
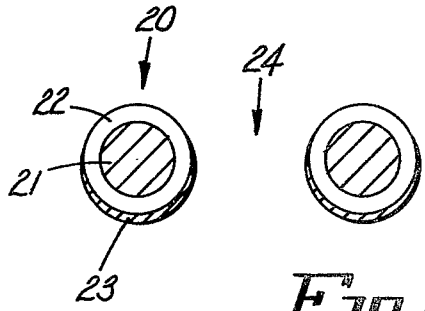
FIG. 2 is a diagrammatic cross-sectional view of another embodiment.

If desired, rather than coating a photoconductive material on one side of the screen and an insulating material which is not photoconductive on the other side thereof, a photoconductor can be coated on all sides of the screen in order to simplify the coating operation. This embodiment is illustrated in FIG. 2 wherein modulator 20 consists of conductor 21 coated on all sides with photoconductor 22 and having conductor 23 deposited upon one side thereof. Apertures in the ion modulator are generally indicated by the numeral 24.

Figure 3:
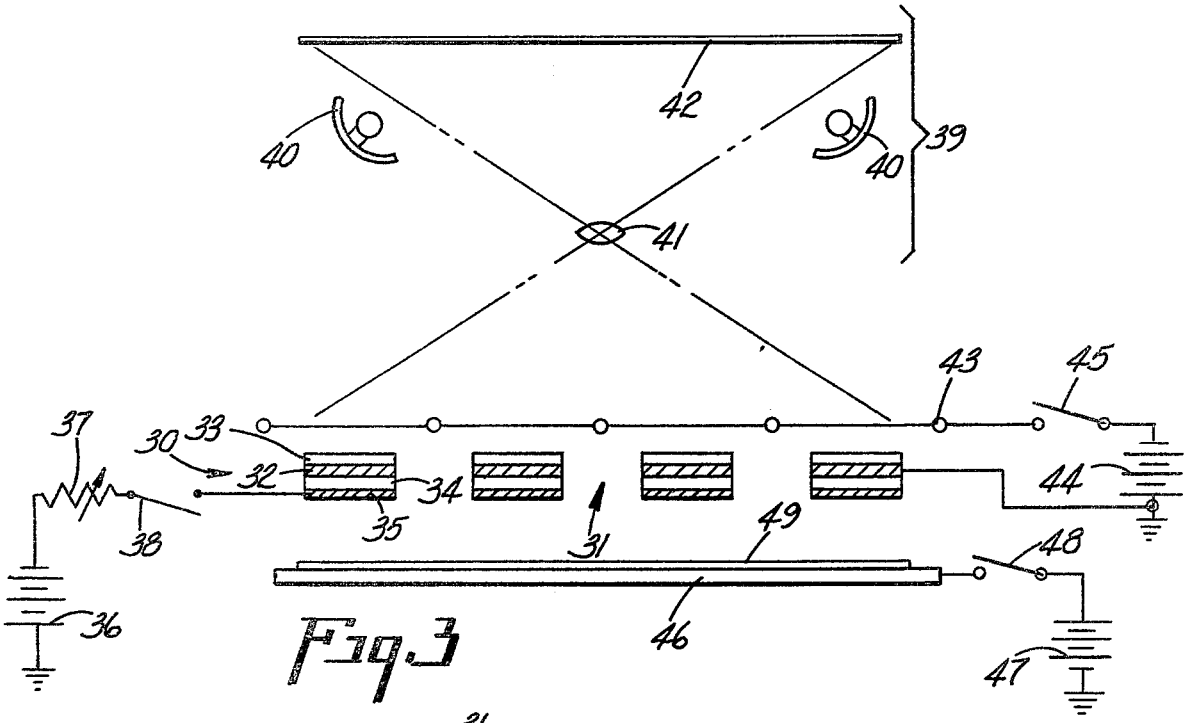
FIG. 3 is a diagrammatic view partly in cross-section of an apparatus suitable for use in this invention.

Referring to FIG. 3, there is shown an apparatus suitable for use in carrying out the process steps of the invention. Modulator 30 having apertures 31 consists of conductor 32, photoconductive layer 33, insulating layer 34 and bias electrode 35. Conductor 32 is connected to ground potential. Electrode 35 is connected to negative potential source 36 through variable resistor 37 by means of switch 38. Imaging system 39 consists of lamps 40 and lens 41 adapted to project a pattern of light and shadow corresponding to background and image areas of original 42 upon modulator 30. Projection corona 43 is connected to negative potential source 44 by means of switch 45. Corona 43 is a transparent corona so as not to interfere with imaging of original 42 upon modulator 30. Collector electrode 46 is connected to positive potential source 47 by means of switch 48 and attracts negative ions projected through apertures 31 of modulator 30. Dielectric 49 is placed adjacent collector electrode 46 serving as a receiving surface for ions projected through modulator 30. A latent electrostatic image corresponding to original 42 is thereby created upon the surface of dielectric 49.

Figure 4:
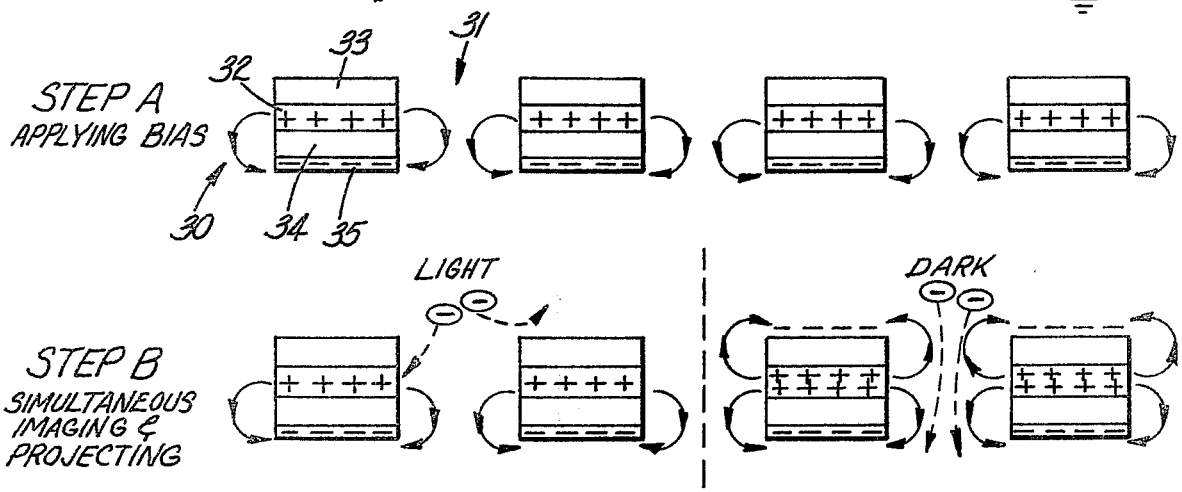
FIG. 4 is a diagrammatic view of the steps involved in a process for producing a latent electrostatic image using the ion modulator of this invention.

FIG. 4 shows the steps involved in one process using the ion modulator of this invention to produce a latent electrostatic image upon a dielectric surface. The explanation of the process will be made with reference to the apparatus shown in FIG. 3.

At the start of the process, switches 38, 45 and 48 are open as shown in FIG. 3. To begin the process switch 38 is closed applying a negative bias potential to electrode 35. The magnitude of the bias potential is determined by the setting on variable resistor 37 which varies the potential applied from negative potential source 36 which may be on the order of from 10 volts to 2,000 volts. The applied bias potential results in charging insulating layer 34. It should be appreciated that the charge density upon insulating layer 34 is a function not only of the bias potential but also of the composition and thickness of insulating layer 34 and that any charge density desired can be arrived at by appropriate choice of these variables. The resulting charge distribution and electric fields are shown schematically in Step A of FIG. 4.

In Step B switch 38 is opened disconnecting electrode 35 from negative potential source 36. At the same time switches 45 and 48 are closed and lamps 40 are turned on. Switch 45 connects projection corona 43 to a source of negative potential 44 which may be on the order of about from 5,000 volts to 8,000 volts. Switch 48 connects collector electrode 46 to a source of positive potential 47 which may be on the order of about from 2,000 volts to 6,000 volts, depending upon the spacing of the collector and the modulator. When lamps 40 are turned on, an image corresponding to original 42 is focused upon modulator 30.

Negative ions are projected from projection corona 43 resulting in the charge distribution and electrostatic fields shown in Step B of FIG. 4. Photoconductive layer 33 is thereby charged as shown. In areas corresponding to image areas in original 42 (dark), the photoconductor acts as an insulator and a charge is built up across photoconductive layer 33. In areas corresponding to background areas in original 42 (light) no charge is built up across photoconductive layer 33 because the photoconductor in the light displays increased conductive properties.

Thus in light areas, corresponding to background areas in the original, the fields around insulating layer 34 are just sufficient to block ions from passing through the screen. In the dark areas corresponding to image areas in the original the charge density on insulating layer 34 is generally less than the charge density present on the surface of photoconductive layer 33 assuming that the insulating layer and photoconductive layer are of the same approximate thickness.

In the light areas the electric field acts to repel negative ions as shown in FIG. 4. In the dark areas, the electric field acts to propel negative ions through apertures 31 in modulator 30. Ions projected through modulator 30 are attracted to dielectric 49 because of the positive potential on collector electrode 46 thereby creating a latent electrostatic image upon the surface of dielectric 49. The charge density across insulating layer 34 can be controlled as above described to permit negative ions to pass through modulator 30 in areas corresponding to image areas in original 42 and to block negative ions in areas corresponding to background. In addition to the advantages described above a decided advantage of this invention is that the charge density produced on the surface of the non-photoconductive insulating layer by means of an applied bias potential will not be discharged in the light. Therefore, this embodiment can be used under ambient light conditions.

This invention has been described with reference to specific embodiments and to various suggested conditions of operation. However, other embodiments can be utilized in order to achieve the results of the ion modulator and the electrophotographic processes of this invention. It is therefore intended that this invention is not to be limited except as defined in the following claims.

We claim:

1. A process for producing a latent electrostatic image corresponding to a graphic original upon a dielectric surface which comprises creating fringing fields in the apertures of an ion modulator situated between a source of ions of a certain polarity and said dielectric surface, said fringing fields having a polarity to block the passage of ions of said certain polarity through said modulator and resulting from a potential applied to an insulating layer of said modulator, and projecting ions of said certain polarity from said source towards said modulator and said dielectric surface while simultaneously exposing said modulator to a pattern of light and dark areas corresponding to said original, whereby said ions are selectively passed through said modulator and deposited upon said dielectric surface to form a latent electrostatic image corresponding to said original, said modulator comprising a member selected from the group consisting of a. a conductive screen coated with a photoconductor and having a conductive layer on one side of said photoconductor, and b. a conductive screen coated on one side with a photoconductor, on the other side with a non-photoconductive insulator, and having a conductive layer adjacent said insulator.

2. A process according to claim 1 wherein said passage of ions through said modulator is blocked in areas corresponding to light areas in said original.

3. A process according to claim 1 wherein said ions are projected upon said modulator from the side opposite said conductive layer.

4. A process according to claim 1 wherein said photoconductor is an inorganic photoconductor.

5. A process according to claim 1 wherein said photoconductor is selenium.

6. A process according to claim 1 wherein said photoconductor is an organic photoconductor.

7. A process according to claim 1 wherein said insulator is a member selected from the group consisting of polystyrene, polyesters and polydiphenylsiloxanes.

8. A process according to claim 1 wherein said ions are of positive polarity.

9. A process according to claim 1 wherein said ions are of negative polarity.

10. A process according to claim 1 wherein said photoconductor is selenium and said ions are of positive polarity.

11. A process according to claim 1 wherein said fringing fields are created by applying a bias potential between said screen and said conductive layer.

* * * * *